United States Patent [19]

Kodama

[11] 4,363,997

[45] Dec. 14, 1982

[54] FLUORESCENT LAMP HAVING REFLECTIVE LAYER

[75] Inventor: Churyo Kodama, Ohme, Japan

[73] Assignee: Hitachi, Ltd., Tokyo, Japan

[21] Appl. No.: 185,163

[22] Filed: Sep. 8, 1980

[30] Foreign Application Priority Data

Sep. 21, 1979 [JP] Japan ..... 54/120640

[51] Int. Cl.[3] ..... H01J 61/44; H01J 61/48

[52] U.S. Cl. ..... 313/487; 313/488

[58] Field of Search ..... 313/488, 487, 486

[56] References Cited

U.S. PATENT DOCUMENTS

| | | | |
|---|---|---|---|
| 2,135,732 | 11/1938 | Randall et al. | 313/488 |
| 2,854,600 | 9/1958 | Van De Weijer et al. | 313/488 |
| 3,225,241 | 12/1965 | Spencer et al. | 313/488 |
| 3,275,872 | 9/1966 | Chernin et al. | 313/488 |
| 3,409,792 | 11/1968 | Martyny et al. | 313/487 |
| 3,886,396 | 5/1975 | Hammer et al. | 313/486 |

FOREIGN PATENT DOCUMENTS 36-22794 11/1961 Japan .

*Primary Examiner*—Palmer C. Demeo

*Attorney, Agent, or Firm*—Kenyon & Kenyon

[57] ABSTRACT

The present invention relates to a fluorescent lamp of the reflective layer type comprising a first phosphor layer and a second phosphor layer laminated partially on the first phosphor layer. The first phosphor layer is formed on the entire face in the circumferential direction of the inner wall of a glass tube, and the second phosphor layer is formed on the first phosphor layer at a certain coating angle along the axial direction of the glass tube. The average particle size of the phosphor constituting the first phosphor layer is different from the average particle size of the phosphor constituting the second phosphor layer. In the fluorescent lamp of the reflective layer type having this structure, a high illuminance can be obtained.

10 Claims, 5 Drawing Figures

FLUORESCENT LAMP HAVING REFLECTIVE LAYER

BACKGROUND OF THE INVENTION

The present invention relates to a fluorescent lamp having a reflective layer. More particularly, the present invention relates to a fluorescent lamp in which phosphor layers are partially laminated and a substantially reflective function is exerted by utilizing the difference of the thickness between the phosphor layers.

Ordinary fluorescent lamps are formed by coating a single layer of a phosphor on the entire surface of the inner wall of a glass tube so that the thickness is substantially uniform. In such ordinary fluorescent lamps, distribution of irradiance substantially equal in the radial direction from the center of the glass tube is obtained. However, in practical application, the luminous flux in the direction of main irradiance, that is, in a specific radial direction from the center of the glass tube, is mainly used.

For this purpose, a fluorescent lamp having a reflective layer is suitable. As typical instance of the fluorescent lamp of this type, there can be mentioned a fluorescent lamp in which a reflective layer of titanium oxide or the like is formed on the inner wall of a glass tube on the side opposite to the direction of main irradiance and a phosphor layer is coated on the entire inner face of the glass tube. In this fluorescent lamp, the luminous flux generated in the glass tube is convergently radiated from the light transmitting face in the lower portion of the glass tube to obtain a strong illuminance just below the lamp. We already proposed a fluorescent lamp having a sectional structure shown in FIG. 1 (see U.S. patent application Ser. No. 089,744 filed on Oct. 31, 1979). FIG. 1 illustrates the structure of the section of a straight or circular fluorescent lamp of the above-mentioned reflective layer type taken vertically to the central axis of a glass tube 1. In this lamp, a first phosphor layer 2 is formed on the entire face of the inner wall of the glass tube and a second phosphor layer 3 is formed on a part of the first phosphor layer 2, for example, along the axial direction of the glass tube 1 at a coating angle $\theta$ of 180°. In this fluorescent lamp, on the inner wall of the glass tube 1 there is formed a phosphor layer comprising a thick portion where the phosphor layers 2 and 3 are laminated and a thin portion consisting solely of the phosphor layer 2. The thick portion has not only the function as the reflective coating but also the function of light transmission. Namely, this fluorescent lamp of the reflective layer type is characterized in that the illuminance in the direction of main irradiance is increased and simultaneously, a certain illuminance is given also in the direction opposite to the direction of main irradiance.

Ordinarily, a laminated phosphor layer structure such as mentioned above is formed by first coating a phosphor uniformly on the entire face of the inner wall of the glass tube 2 and drying the coating to form a phosphor layer 2, then coating a phosphor uniformly on a part of the phosphor layer 2, for example, in a region of a coating angle $\theta$ of 180° and drying the coating to form a phosphor layer 3, and finally baking the phosphor layers 2 and 3 simultaneously.

A combination of phosphors having the same emission spectrum of light are ordinarily used for the fluorescent lamp of the reflective layer type including laminated phosphor layers. However, even if phosphors differing in the emission spectrum of light are used in combination, it is possible to increase the illuminance in the direction of main irradiance and improve the color rendering properties.

In the conventional fluorescent lamp having the entire face of the inner wall of the glass tube 1 uniformly coated with phosphors, phosphors having a particle size providing a highest capacity are used as the phosphors of the layers 2 and 3, and halo-phosphate phosphors having an average particle size of 10 to 14 $\mu$m are used most popularly.

In the fluorescent lamp having the above-mentioned laminated structure of phosphor layers, the effect of improving the illuminance in the direction of main irradiance is only such that the illuminance is increased by 15 to 20% over the illuminance of the conventional fluorescent lamp, and this effect of increasing the illuminance is still insufficient as compared with the effect attained by the conventional fluorescent lamp of the reflective layer type formed by using a reflective material such as titanium oxide.

SUMMARY OF THE INVENTION

It is therefore a primary object of the present invention to provide a fluorescent lamp of the reflective layer type having the above-mentioned laminated structure of phosphor layers, in which the illuminance in the direction of main irradiance is further increased.

In accordance with the present invention, this object can be attained by a fluorescent lamp of the reflective layer type comprising a glass tube, a first phosphor layer formed on the entire face of the inner wall of said glass tube and a second phosphor layer formed on said first phosphor layer at a certain reflection angle along the axial direction of said glass tube, wherein the average particle size of a phosphor constituting said first phosphor layer is at least 3 $\mu$m, the average particle size of a phosphor constituting said second phosphor layer is at least 6 $\mu$m and the average particle size of the phosphor constituting said first phosphor layer is smaller than the average particle size of the phosphor constituting said second phosphor layer.

Namely, according to the present invention, in a fluorescent lamp of the reflective layer type having a laminated structure of first and second phosphor layers, the average particle sizes of the phosphors constituting the first and second phosphor layers are specifically controlled so that the illuminance in the direction of main irradiance is improved.

In the fluorescent lamp of the reflective layer type having the above-mentioned characteristic laminated structure of phosphor layers according to the present invention, the illuminance can assuredly be increased over the conventional fluorescent lamp of the reflective layer type having a laminated structure by using phosphors having the same average particle size.

DETAILED DESCRIPTION OF THE PREFERRED EMBODIMENTS

Figure 1:
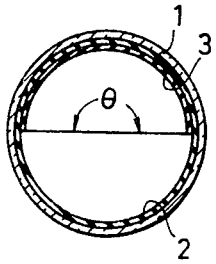
FIG. 1 is a diagram illustrating the sectional structure of a fluorescent lamp of the reflective layer type to which the present invention is applied.
Figure 2:
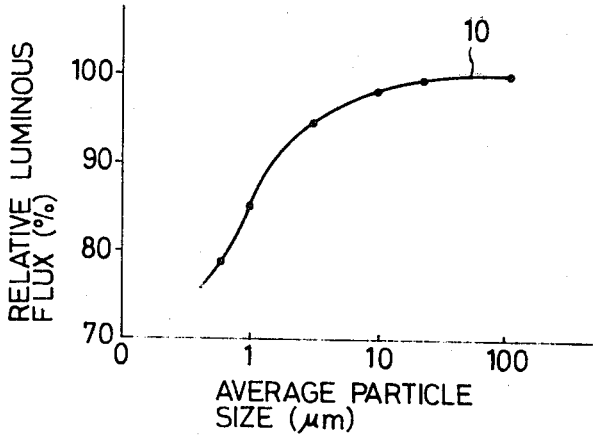
FIG. 2 is a graph illustrating the relation between the average particle size of a phosphor and the relative luminous flux.

The structure of the section of a straight or circular fluorescent lamp of the reflective layer type taken vertically to the central axis of the glass tube in the present invention is quite the same as the sectional structure of the conventional fluorescent lamp of the reflective layer type shown in FIG. 1, except that in the conventional fluorescent lamp of the reflective layer type, the average particle size of the phosphor constituting the phosphor layer 2 is the same as the average particle size of the phosphor constituting the phosphor layer 3, whereas in the fluorescent lamp of the reflective layer type according to the present invention, the average particle size of the phosphor constituting the phosphor layer 2 is at least 3 μm, the average particle size of the phosphor constituting the phosphor layer 3 is at least 6 μm and the average particle size of the phosphor constituting the phosphor layer 2 is smaller than the average particle size of the phosphor constituting the phosphor layer 3. This novel feature is based on experimental results described hereinafter. In the fluorescent lamp of the reflective layer type having the sectional structure shown in FIG. 1, if the portion where the phosphor layers 2 and 3 are laminated is used as the reflective layer and the remaining portion where only the phosphor layer 2 is present is used as the transmission layer, the functions required for the phosphor layer 2 are the function of reflection of light in the reflective layer and the luminous function in the transmission layer, and the function required for the phosphor layer 3 is the luminous function. It is known that increase of the average particle size of the phosphor results ordinarily in some increase of the luminous flux of the phosphor. Curve 10 in FIG. 2 illustrates changes of the relative luminous flux (%) observed when the average particle size of the phosphor is changed from 0.7 μm to 100 μm in a fluorescent lamp in which a single layer of the phosphor is uniformly coated on the entire face of the inner wall of a glass tube. It is seen that as the average particle size is increased, the relative luminous flux is increased. It also is known that decrease of the average particle size results in increase of the reflective characteristic.

Therefore, it is expected that if optimum values are found for the average particle sizes of the phosphors constituting the phosphor layers 2 and 3, the above functions required for the phosphor layers will sufficiently be exerted and the illuminance will therefore be improved over that of the conventional fluorescent lamp of the reflective layer type where the average particle sizes of the phosphors constituting the phosphor layers 2 and 3 are the same.

Figure 3:
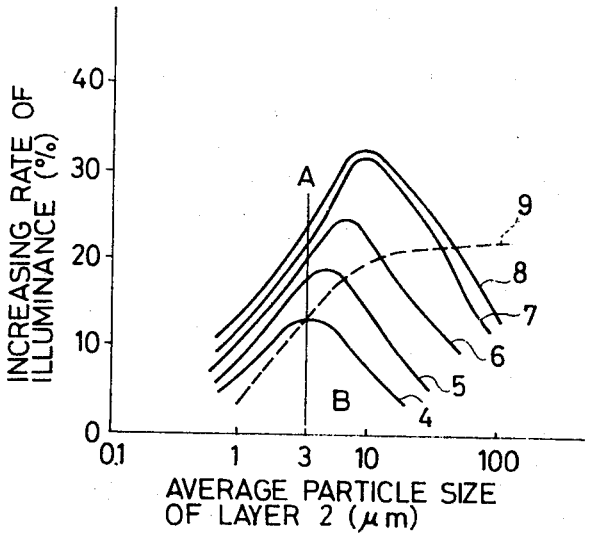
FIG. 3 is a graph illustrating the relation between the combination of average particle sizes of the phosphor layers 2 and 3 and the rate of increase of the illuminance in the present invention.

Accordingly, detailed experiments and examinations were made on the effect of increasing the illuminance in the fluorescent lamp of the reflective layer type having the phosphor layer laminated structure shown in FIG. 1 by changing the average particle sizes of the phosphors constituting the phosphor layers 2 and 3 in the range of from 0.7 to 100 μm, the amounts coated of the phosphors in the range of from 1 to 5 mg/cm$^2$ and the coating angle, that is, the reflective layer angle $\theta$, in the range of from 0° to 360°, while using the phosphors of the same or different light emission spectrum and using a straight, circular or other glass tube for the fluorescent lamp of the reflective layer type. Typical instances of the obtained results are shown in FIG. 3. In the graph of FIG. 3, the average particle size (μm) of the phosphor layer 2 is plotted on the abscissa and the illuminance increasing rate (%) over the conventional fluorescent lamp of the ordinary reflective layer type is plotted on the ordinate, while using the average particle size (μm) of the phosphor layer 3 as the parameter. Each of the amounts coated of the phosphor layers is 3 mg/cm$^2$ and the reflection angle $\theta$ is 180°. The light emission spectrum of the phosphor constituting the phosphor layer 2 is the same as the light emission spectrum of the phosphor constituting the phosphor layer 3, and a 20-watt straight fluorescent lamp of the reflective layer type is used. Curves 4, 5, 6, 7 and 8 show results obtained when the average particle size of the phosphor constituting the phosphor layer 3 is adjusted to 3, 6, 12, 30 and 40 μm, respectively. Curve 9 indicated by the dot line shows the locus of the illuminance increasing rates of the respective cases, obtained when the average particle size of the phosphor constituting the phosphor layer 2 is the same as the average particle size of the phosphor constituting the phosphor layer 3. In short, the crossing points of the curve 9 with the curves 4, 5, 6, 7 and 8 indicate the illuminance increasing rates obtained when the equal average particle sizes of the phosphor layers 2 and 3 are 3, 6, 12, 30 and 40 μm, respectively. The region above the curve 9 is the region A in which the average particle size of the phosphor layer 2 is smaller than the average particle size of the phosphor layer 3 and the region below the curve 9 is the region B in which the average particle size of the phosphor layer 2 is larger than the average particle size of the phosphor layer 3. Hereupon, the average particle sizes of the phosphors constituting the phosphor layers 2 and 3 providing a high illuminance increasing rate than the illuminance increasing rate obtained in the region A when the phosphors constituting the phosphor layers 2 an 3 have the same average particle size will now be examined. In the case where the average particle size of the phosphor layer 3 is 3 μm (curve 4), even if the average particle size of the phosphor layer is smaller than 3 μm, the illuminance increasing rate is not higher than the illuminance increasing rate (13%) obtained when each of the average particle sizes of the phosphor layers 2 and 3 is 3 μm. In the case where the average particle size of the phosphor layer 3 is 6 μm (curve 5), if the average particle size of the phosphor layer is at least 3 μm (but smaller than 6 μm). the obtained illuminance increasing rate is higher than the illuminance increasing rate (17.5%) obtained when each of the average particle sizes of the phosphor layers 2 and 3 is 6 μm. In the case where the average particle size of the phosphor layer is 12 μm (curve 6), if the average particle size of the phosphor layer 2 is at least 3 μm but smaller than 12 μm, the obtained illuminance increasing rate is higher than the illuminance increasing rate (20%) obtained when each of the average particle sizes of the phosphor layers 2 and 3 is 12 μm. Similarly, in the case where the average particle size of the phosphor layer 3 is 30 μm (curve 8), if the average particle size of the phosphor layer 2 is smaller than 30 μm, the obtained illuminance increasing rate is higher than the illuminance increasing rate (21.5%) obtained when each of the average particle sizes of the phosphor layers 2 and 3 is 30 μm. Furthermore, in the case where the average particle size of the phosphor layer 3 is 40 μm (curve 8), if the average particle size of the phosphor layer 2 is at least 3 μm smaller than 40 μm, the obtained illuminance increasing rate is higher than the illuminance increasing rate (22%) obtained when each of the average particle sizes of the phosphor layers is 40 μm. From the foregoing experimental results, it is seen that if the average particle size of the phosphor constituting the phosphor layer 2 is at least 3 μm, the average particle size of the phosphor constituting the phosphor layer 3 is at least 6 μm and if the average particle size of the phosphor constituting the phosphor layer 2 is smaller than the average particle size of the phosphor constituting the phosphor layer 3, the illuminance increasing rate can assuredly be elevated over the illuminance increasing rate obtained when the average particle size of the phosphor constituting the phosphor layer 2 is the same as the average particle size of the phosphor constituting the phosphor layer 3.

As pointed out hereinbefore, the phosphor layer 2 is required to exert the function of reflection of light in the reflective layer and to exert the luminous function and the light transmission function in the transmission layer. Furthermore, the phosphor layer 2 is required to exert the function of adhesion to the glass tube 1. In order to impart a sufficient adhesion function to the phosphor layer 2, it is preferred that the average particle size of the phosphor constituting the phosphor layer 2 be smaller than 10 μm. As pointed out hereinbefore, the phosphor layer 3 is required to exert the luminous function. Furthermore, the phosphor layer 3 is required to exert the function of adhesion to the phosphor layer 2. Since the substance to which the phosphor layer 3 is bonded is not glass but the phosphor, the average particle size of the phosphor layer may exceed 10 μm to some extent. However, as is seen from the experimental results shown in curves 7 and 8 of FIG. 2, if the average particle size of the phosphor layer 3 is larger than 30 μm, the illuminance increasing rate becomes saturated. Accordingly, it is preferred that the average particle size of the phosphor constituting the phosphor layer 3 be smaller than 30 μm.

Figure 4:
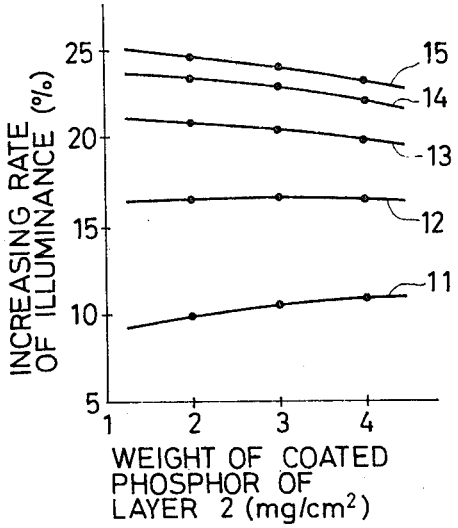
FIG. 4 is a graph illustrating the relation between the amounts coated of phosphors in the phosphor layers 2 and 3 and the rate of increase of the illuminance in the present invention.

FIG. 4 illustrates typical instances of results of experiments made on the relation between the amount coated of the phosphor layer 2 and the illuminance increasing rate with the amount coated of the phosphor layer 3 being used as the parameter. In the experiments, the reflection angle $\theta$ of the reflective layer is 180°, the average particle sizes of the phosphor layers 2 and 3 are 6 μm and 8 μm, respectively, and the same phosphor is used for the layers 2 and 3. In FIG. 4, curves 11, 12, 13, 14 and 15 show the results obtained when the amount coated of the phosphor layer 3 is adjusted to 1, 2, 3, 4 and 5 mg/cm$^2$, respectively. As is seen from these results, if the amount coated of the phosphor layer 3 is increased while keeping the amount coated of the phosphor layer 2 constant, the illuminance increasing rate can be improved. However, if the amount coated of the phosphor layer 2 is smaller than 2 mg/cm$^2$, the decay of the phosphor is conspicuous in the portion other than the reflective layer, that is, the light transmission layer, and the illuminance performance is degraded. If the amount coated of the relfective layer having the laminated structure exceeds 8 mg/cm$^2$, the adhesion strength is reduced, and the phosphors are readily peeled off when a fluorescent lamp of the relfective layer type is manufactured. Accordingly, it is most preferred that each of the amounts coated of the phosphor layers 2 and 3 be 2 to 4 mg/cm$^2$. It has been confirmed that when each of the amounts coated of the phosphor layers 2 and 3 is 3 mg/cm$^2$, the illuminance increasing rate over the conventional fluorescent lamp is 20%.

Figure 5:
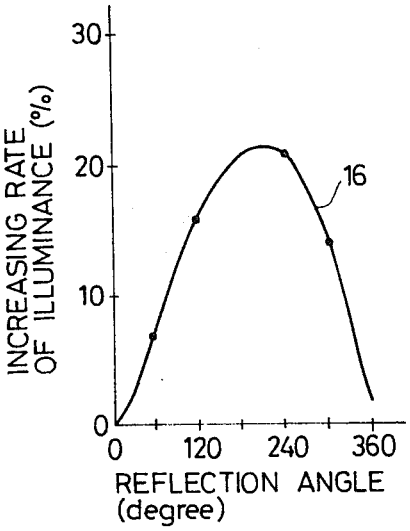
FIG. 5 is a graph illustrating the relation between the reflection angle $\theta$ of the reflective layer and the rate of increase of the illuminance.

FIG. 5 illustrates typical instances of results of experiments made on the relation between the reflection angle $\theta$ of the reflective layer and the illuminance increasing rate. In the experiments, each of the amounts coated of the phosphor layers 2 and 3 is 3 mg/cm$^2$, and the average particle sizes of the layers 2 and 3 are 6 μm and 8 μm, respectively. As is seen from the results shown in curve 16 of FIG. 5, in order to maintain the illuminance increasing rate at a level of at least 20%, it is preferred that the reflection angle $\theta$ of the reflective layer be in the range of from 180° to 240°. If the reflection angle $\theta$ of the reflective layer is outside this range, the illuminance increasing rate is drastically reduced. Although the preferred range of the reflection angle $\theta$ of the reflective layer is from 180° to 240°, from the viewpoint of saving of the expenses for the phosphor constituting the phosphor layer 3, it is most preferred that the reflection angle $\theta$ of the reflective layer be 180°. In this case, the illuminance increasing rate is 20%.

In the foregoing examples, the phosphors of the phosphor layers 2 and 3 have the same light emission spectrum. However, the present invention can also be applied to the case where phosphors differing in thc light emission spectrum are used. If the light emission spectrum is equal in both the phosphors, since the same kind of the phosphor is used for both the layers, the manufacturing cost can be lowered. When phosphors differing in the light transmission spectrum are used, there are attained another effects of increasing the illuminance in the direction of main irradiance and improving the color rendering properties.

As will be apparent from the foregoing illustration, in a fluorescent lamp having a structure in which the reflective characteristics are brought about by partial lamination of phosphors, by adjusting the average particle sizes of phosphors constituting the respective phosphors to optimum values, the illuminance can remarkably be increased. The illuminance increasing rate of the fluorescent lamp of the reflective layer type according to the present invention is about 10% at highest over the illuminance of the fluorescent lamp of the reflective layer type in which the respective phosphors have the same average particle size. From the viewpoint of the historical fact that about 10 years have been used for increasing the luminous flux by 5%, the above-mentioned value is considerably large. Fluorescent lamps available at the present are roughtly divided into the straight type and the circular type. In the foregoing examples, the straight type is illustrated. However, when the present invention is applied to fluorescent lamps of the circular type which are used in ordinary houses most frequently, a very high illuminance can be obtained and the color rendering properties can be improved, with the result that prominent advantages can be attained by the present invention.

What is claimed is:

1. A fluorescent lamp of the reflective layer type comprising a glass tube, a first phosphor layer formed on the entire face of the inner wall of said glass tube and a second phosphor layer formed on said first phosphor layer at a certain reflection angle along the axial direction of said glass tube, wherein the average particle size of a phosphor constituting said first phosphor layer is at least 3 μm, the average particle size of a phosphor constituting said second phosphor layer is at least 6 μm and the average particle size of the phophor constituting said first phosphor layer is smaller than the average particle size of the phosphor constituting said second phosphor layer.

2. A fluorescent lamp of the reflective layer type as set forth in claim 1, wherein the average particle size of the phosphor constituting the first phosphor layer is smaller than 10 μm.

3. A fluorescent lamp of the reflective layer type as set forth in claim 1, wherein the average particle size of the phosphor constituting the second phosphor layer is smaller than 30 μm.

4. A fluorescent lamp of the reflective layer type as set forth in claim 1, wherein each of the amounts coated of the phosphors of the first and second phosphor layers is 2 to 4 mg/cm$^2$.

5. A fluorescent lamp of the reflective layer type as set forth in claim 1, wherein the reflection angle is in the range of 180° to 240°.

6. A fluorescent lamp of the reflective layer type as set fort in claim 5, wherein the reflection angle is 180°.

7. A fluorescent lamp of the reflective layer type as set forth in claim 1, wherein the phosphor constituting the first phosphor layer has the same light emission spectrum as that of the phosphor constituting the second phosphor layer.

8. A fluorescent lamp of the reflective layer type as set forth in claim 1, wherein the phosphor constituting the first phosphor layer has a light emission spectrum different from that of the phosphor constituting the second phospher layer.

9. A fluorescent lamp of the reflective layer type as set forth in claim 1, wherein the glass tube is a straight tube.

10. A fluorescent lamp of the reflective layer type as set forth in claim 1, wherein the glass tube is a circular or curved tube.

* * * * *